US005567577A

United States Patent [19]

Welter et al.

[11] Patent Number: 5,567,577

[45] Date of Patent: Oct. 22, 1996

[54] PHOTOGRAPHIC ELEMENTS CONTAINING RELEASE COMPOUNDS

[75] Inventors: Thomas R. Welter, Webster; David A. Dickinson, Brockport; Keath T. Chen, Rochester, all of N.Y.

[73] Assignee: Eastman Kodak Company, Rochester, N.Y.

[21] Appl. No.: 539,381

[22] Filed: Oct. 5, 1995

Related U.S. Application Data

[63] Continuation of Ser. No. 250,148, May 27, 1994, abandoned.

[51] Int. Cl.[6] ..... G03C 7/305; G03C 1/295; G03C 1/34; G03C 1/42

[52] U.S. Cl. ..... 430/544; 430/564; 430/566; 430/955; 430/957; 430/959

[58] Field of Search ..... 430/955, 957, 430/958, 959, 544, 566, 564

[56] References Cited

U.S. PATENT DOCUMENTS

| | | | |
|---|---|---|---|
| 3,674,478 | 7/1972 | Grasshoff et al. | 430/219 |
| 4,248,962 | 2/1981 | Lau | 430/382 |
| 4,409,323 | 10/1983 | Sato et al. | 430/544 |
| 4,684,604 | 8/1987 | Harder | 430/375 |
| 4,775,610 | 10/1988 | Kitaguchi et al. | 430/957 |
| 5,034,311 | 7/1991 | Slusarek et al. | 430/544 |
| 5,084,376 | 1/1992 | Suda et al. | 430/957 |
| 5,116,717 | 5/1992 | Matsushita et al. | 430/264 |
| 5,118,596 | 6/1992 | Matushita et al. | 430/957 |
| 5,240,821 | 8/1993 | Texter et al. | 430/959 |
| 5,283,162 | 2/1994 | Kapp et al. | 430/382 |
| 5,354,650 | 10/1994 | Southby | 430/955 |

FOREIGN PATENT DOCUMENTS

| | | |
|---|---|---|
| 167168 | 8/1986 | European Pat. Off. . |
| 0335319 | 10/1989 | European Pat. Off. . |
| 0547707A1 | 6/1993 | European Pat. Off. . |
| 0551673A1 | 7/1993 | European Pat. Off. . |
| 92/21064A | 11/1992 | WIPO . |

*Primary Examiner*—Richard L. Schilling
*Attorney, Agent, or Firm*—Sarah Meeks Roberts

[57] ABSTRACT

A photographic element comprising a support having located thereon at least one silver halide emulsion layer, the element containing a release compound that provides a non-imagewise distribution of a photographically active moiety, the release compound comprising a blocking group from which the photographically active moiety is released, the release compound further comprising a ballasting group other than a coupler moiety, and an aqueous solubilizing group, both the ballasting group and the aqueous solubilizing group being attached to the blocking group.

12 Claims, No Drawings

PHOTOGRAPHIC ELEMENTS CONTAINING RELEASE COMPOUNDS

This is a Continuation of U.S. application Ser. No. 250,148, filed May 27, 1994, now abandoned.

FIELD OF THE INVENTION

This invention relates to silver halide photographic elements. In particular, it relates to photographic elements containing release compounds which provide a non-imagewise distribution of a image-modifying compound.

BACKGROUND OF THE INVENTION

In silver halide color photographic materials, images are formed by reaction of oxidized silver halide developing agent and a dye precursor known as a coupler. In forming such images, it has become relatively common practice in the art to incorporate image-modifying compounds into either the developing solutions or the photographic materials themselves. These image-modifying compounds can impact such photographic properties as sharpness, granularity, contrast and color reproduction.

Incorporation of image-modifying compounds into developing solutions typically limits the ability of the compounds to adequately impact the photographic element since they must diffuse through multiple emulsion, filter or support layers. Direct incorporation of image-modifying compounds into photographic materials, by contrast, often leads to unacceptable image reproduction as such compounds can prematurely interact with other components of the photographic elements, or can decompose during shelf keeping.

It has thus become accepted to attach these image-modifying compounds to coupler moieties and to have them released in an imagewise manner during development of the photographic material. This, however, has the dual disadvantage of requiring image formation (as the coupler moiety reacts with oxidized developer) whenever the presence of an image-modifying compound is desired, and of providing only an imagewise release of the image-modifying compound.

There has recently become known alternative means for incorporating image-modifying compounds into photographic materials. Image-modifying compounds have been inactivated by timing groups which generally release after exposure to hydroxide ions, by blocking groups which release after reaction with some other compound, or by combinations of the two. Specific examples of such image-modifying compounds and their inactivating groups are described in, for example, U.S. Pat. Nos. 4,248,962; 4,409,323; 4,684,604; 5,034,311; 5,283,162; European Patent Application 0 167 168; and in U.S. Pat. No. 5,354,650.

Because timing groups release the compounds to which they are attached after exposure to hydroxide ions, they may, when used alone, prematurely release in the typical water-containing photographic emulsion. Such premature release would allow the image-modifying compounds to diffuse away from their initial location, and would make control over the location where the image-modifying compound acts impractical. For this reason, timed image-modifying compounds are often undesired.

Prior known blocked image-modifying compounds are also often undesired. However, the reason for this is that their release rates—the rate at which they unblock to expose an active image-modifying compound to the photographic material—and/or shelf-life stability are typically pH dependent. That is, known blocking groups have been practically viable only with highly alkaline (pH>13) activator solutions. This has been incompatible with modern commercial processing, especially in the color reversal areas, and thus has made the use of such compounds fairly impractical.

It has further been found that known blocked image-modifying compounds, such as those disclosed in U.S. Pat. No. 5,116,717, can wander within the photographic materials during prolonged shelf-keeping. This can lead to the complete washing out of the image-modifying compound during development, or to the unblocking of the image-modifying compounds at sites other than those intended, thus deleteriously impacting photographic properties.

The blocked image-modifying compounds of U.S. Pat. No. 5,354,650, though ballasted, are provided in an imagewise manner, and after reaction with a second compound that is photographically inert in the layer in which it is coated, or in the form in which it is released. Thus, when it desired to provide image-modifying compounds to photographic materials in a non-imagewise manner, the teachings of U.S. Pat. No. 5,354,650, are inadequate. Further, as the compounds of this reference fail to provide sufficient water solubility, release of active image-modifying compounds in the presence of nucleophiles normally present in processing baths (e.g., sulfite) will be limited, the result being ineffective or improper image modification.

SUMMARY OF THE INVENTION

It is therefore an object of the present invention to provide photographic materials comprising novel blocked image-modifying compounds that are unblocked in a non-imagewise manner and that provide adequate control over image modification.

This and other objects of the invention, which will be apparent from the description that follows, are accomplished by a photographic element comprising a support having located thereon at least one silver halide emulsion layer, the element containing a release compound that provides a non-imagewise distribution of a photographically active moiety, the release compound comprising a blocking group from which the photographically active moiety is released, the release compound further comprising a ballasting group other than a coupler moiety, and an aqueous solubilizing group, both the ballasting group and the aqueous solubilizing group being attached to the blocking group.

The novel blocked image-modifying compounds employed in the present invention provide for the opportunity to specifically control the strength and location of image modification. Further, when such compounds unblock to form development inhibitors, excellent control of push processing in reversal films can be obtained.

DETAILED DESCRIPTION OF THE INVENTION

The present invention relates to photographic elements containing a release compound that provides a non-imagewise distribution of a photographically active moiety. The release compound comprises a blocking group from which the photographically active moiety is released, a ballasting group other than a coupler moiety, and an aqueous solubilizing group, both the ballasting group and the aqueous solubilizing group being attached to the blocking group. Preferably, the photographic element contains a release compound comprising, as the blocking group, an aromatic ring system which is unsubstituted or substituted with one or more electron withdrawing groups and, optionally, a timing group or series of timing groups, from which the photographically active moiety is released.

By timing group, it is meant any of the timing groups known in the art, preferably those that function by electron transfer down a conjugated chain or by cyclization reaction (nucleophilic displacement). Other groups which decompose to form small molecules such as carbon dioxide or formaldehyde are also contemplated. Suitable timing groups for practice with the present invention include those disclosed in U.S. Pat. Nos. 4,248,962; 4,409,323; 4,684,604; 5,034,311 and 5,055,385; and European Patent Application 0 167 168; all of which are incorporated herein by reference. Multiple timing groups are specifically contemplated and these may be the same or they may be different.

As indicated, the preferred release compounds comprise an aromatic ring system from which, when no timing groups are present, the photographically active moiety is released. When at least one timing group is present, the aromatic ring system releases both the timing group and the photographically active moiety. The timing group then releases the photographically active moiety in accordance with its release profile.

By aromatic ring system, it is meant a group having at least one aromatic ring, preferably a 5, 6, or 7 membered ring, from which a photographically active moiety or timing group is released. The aromatic ring system may be monocyclic or polycyclic. It may be comprised of entirely carbon atoms, or it may contain heteroatoms so as to form a heteroaromatic ring system. Specific examples of the aromatic ring system include benzene, pyridine, pyrrole, furan, thiophene, imidazole, thiazole, oxazole, pyrazole, isothiazole, isoxazole, triazole, tetrazole, pyrimidine, pyrazine, and similar rings. Furthermore, such rings may be substituted. Substituents include halogen, alkyl, alkenyl, alkynyl, aryl, heteroaryl, carboxy, carbonamido, sulfonamido, nitro, cyanofluoroalkyl, fluorosulfonyl, amino, sulfamyl, carbamyl, formyl, arylcarbonyl, alkylcarbonyl, carboxyaryl, carboxyalkyl, alkyl-carbonamido, arylcarbonamido, fluoroarylsulfonyl, fluoroalkylsulfonyl, aryloxy, alkyloxy, arylthio, alkylthio, phosphenyl, and the like. Other suitable substituents include oxo, imine, oximino, alkylidene, arylidine, thio, and azimino, and these substituents, if present, are preferably on a ring other than the ring from which the photographically active moiety or timing group is released.

It is preferred that the aromatic ring system employed in the present invention comprise at least one 5, 6, or 7 membered carbocyclic, non-heteroaromatic, ring from which the timed or untimed photographically active moiety is released. The carbocyclic ring is preferably substituted with at least two electron withdrawing groups. Preferred examples of carbocyclic rings or aromatic ring systems including at least one carbocyclic ring include benzene, naphthalene, indene, fluorene, anthracene, phenanthrene, indole, isoindole, benzimidazole, benzoxazole, benzothiazole, benzofuran, benzothiophene, quinoline, isoquinoline, quinoxaline, quinazoline, phthalazine, cinnoline, carbazole, dibenzofuran, dibenzothiophene and the like. These may be substituted or unsubstituted as described above.

The release compounds of the present invention also comprise a ballasting group which is preferably attached to the blocking group. Thus, the ballasting group may be found on either (or both) the timing group or the aromatic ring system. Preferably, it is found on the aromatic ring system. In limited instances, when the aromatic ring system is a 5, 6, or 7 membered carbocyclic non-heteroaromatic ring, the ballasting group may also be found on the photographically active moiety.

Ballasting groups known in the art are suitable for the present invention. Preferably, they are groups which prevent substantial migration of the release compounds within the photographic element. Migration should be limited during both shelf keeping and processing. Preferably, the ballasting groups are large organic molecules, typically containing at least 8, preferably containing at least 12, and more preferably at least 15, contiguous atoms and including substituted or unsubstituted alkyl, aryl, or aralkyl groups.

Known ballasting groups suitable for the present invention include 4-tridecyloxyphenyl, 4-(2,4-di-t-pentyl-phenoxy)butyl, 3-pentadecylphenyl, n-octadecyl, 5-tetradecylcarbonamido-2-chlorophenyl, 5-(N-methyl-N-octadecyl sulfamoyl)-2-chlorophenyl, 2-tetradecyl-oxyphenyl and 4-t-octylphenoxyphenyl. These groups, as well as other ballasting groups capable of being employed in the present invention, may further comprise an aqueous solubilizing group. In such instances, when the ballasting group contains an aqueous solubilizing portion (group) and is attached to the aromatic ring system, the aqueous solubilizing portion can not be directly attached to the aromatic ring system. Instead, it must be indirectly attached to the aromatic ring system through at least one carbon atom, preferably at least three carbon atoms, and more preferably at least five carbon atoms. It is also preferred that the ballasting group and aqueous solubilizing portion not be linearly attached to each other but rather branch from an intervening carbon atom.

In instances where the ballasting group contains the aqueous solubilizing group and is attached to a timing group, it is contemplated that the aqueous solubilizing portion (group) be attached directly to the timing group. It is preferred, however, that the orientation of aqueous solubilizing portion to the ballasting group be as described above for when the ballasting group containing the aqueous solubilizing group is attached to the aromatic ring system.

In a preferred embodiment, the release compounds comprise a water solubilizing group that is attached, either directly or indirectly, to the timing group, or is attached indirectly through at least one carbon atom to the aromatic ring system. By aqueous solubilizing group, it is meant any group capable of facilitating the removal of the aromatic ring system at a useful rate in a nucleophile containing processing bath. The group should have an intrinsic hydrophilicity, or should be such as to be capable of substantial ionization under processing conditions. Examples include carboxylic acids; sulfonamides; thiols; cyanamides; ureas; sulfonylureas; imides; sulfonic acids; polyethers having greater than 2 repeating units; amines and polyamines; cationic centers such as ammonium, sulfonium or phosphonium groups; amides such as carbonamides or phosphonamides; alcohols or polyalcohols; and salts thereof.

The most preferred groups are selected from carboxy, carboxyalkyl, sulfo, sulfoalkyl, sulfonamides, phosphato, phosphatoalkyl, phosphono, phosphonoalkyl, carbonamido, sulfonamido, hydroxy, and salts thereof. Optimally, the groups are carboxy or sulfo, and salts thereof.

In the present invention, the aqueous solubilizing group enables the aromatic ring system to be removed from the blocking group during processing as a result of reaction with a nucleophile contained in the processing bath, thus releasing the timed or untimed photographically active moiety. The nucleophile contained in the processing bath can include any nucleophile present in processing baths; preferably sulfite ions, oximes, hydroxylamines, thiocyanates, or thiolates; more preferably ions other than oxygen or nitrogen nucleophiles; and optimally sulfite ions. Sulfite ions are typically present in developer baths, fixing baths, conditioner baths, and bleach accelerator baths. They can come from salts of sulfite, such as sodium sulfite or potassium sulfite; salts of bisulfite such as sodium bisulfite, potassium bisulfite, or sodium formaldehyde bisulfite; or salts of metabisulfite, such as sodium metabisulfite or potassium metabisulfite. The concentration of sulfite can be in the range of 0.0001 to 2.0 molar, preferably in the range 0.01 to 1.0 molar.

The photographically active moieties employed in the release compounds of the present invention can be any of the groups usefully made available in photographic elements. These include development accelerators, development inhibitors, bleach accelerators, bleach inhibitors, developing agents (e.g. competing developing agents or auxiliary developing agents), dyes, silver complexing agents, fixing agents, toners, hardeners, tanning agents, fogging agents, antifoggants, antistain agents, couplers and stabilizers.

Examples of such photographically active moieties are disclosed in *Research Disclosure,* December 1989, Item No. 308119, Sections VII–F,I,J; VIII; X; XX; and XXI, which are incorporated herein by reference.

Preferably, the photographically active moiety is other than a dye. More preferably, it is a development inhibitor, a development accelerator or a bleach accelerator.

The photographically active moiety is inert when attached to the timing group or aromatic ring system. Only upon release from these two groups can the photographically active moiety exert its intended effect. By inert, it is meant the moiety does not exert its ultimately desired effect. It may, however, exert other incidental photographic effects.

The photographically active moiety preferably contains a heteroatom which is blocked by direct attachment to the timing group or aromatic ring system. Upon removal of the timing group, when present, and the aromatic ring system upon reaction of the release compound with a nucleophile contained in the processing bath, the photographically active moiety becomes active for its intended purpose.

In the preferred embodiments of the present invention, the release compound has the structure

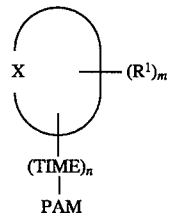

wherein

X represents the atoms to complete an aromatic ring system;

$R^1$ is an electron withdrawing moiety;

m is 0, 1, 2 or 3, preferably 2 or 3;

TIME is a timing group;

n is 0, 1, 2 or 3, preferably 0 or 1;

PAM is a photographically active moiety; and wherein the release compound further comprises a ballasting group other than a coupler moiety, and an aqueous solubilizing group, the ballasting group attached either directly or indirectly to TIME or X, and the aqueous solubilizing group attached either directly or indirectly to TIME, or attached indirectly to X through at least one carbon atom.

Preferably, X represents the atoms necessary to complete a five or six membered aromatic ring comprised of substituted or unsubstituted carbon atoms, or nitrogen atoms wherein no more than three nitrogens are present in the ring. When the ring is carbocyclic, that is comprised of substituted or unsubstituted carbon atoms, it may be fused to a heterocyclic ring or other carbocyclic rings. In this manner, it is contemplated that X can represent a moiety having the following structure:

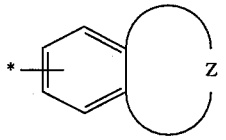

wherein

Z represents the atoms to form a fused heterocyclic or carbocyclic ring. These atoms may be further substituted and may be fused with additional heterocyclic or carbocyclic rings. * designates the point of attachment of X to $(TIME)_n$-PAM.

Electron withdrawing groups are those groups which display a positive Hammett sigma value as described, for example, in Advanced Organic Chemistry by F. A. Carny and R. J. Sundberg, volume A, pages 179–190; Plenum Press, New York 1984. Examples include nitro; nitroso; azide; azo; cyano; aryl or alkyl sulfones sulfoxides and ketones; aryloxy or alkyloxy carboxylate esters; sulfonate esters; phosphate esters; arylamino or alkylamino carboxylic amides; tertiary substituted alkylamino or arylamino sulfonamides; halogen; fluoroalkyl; and other similar groups. In the present invention, the electron withdrawing group is preferably non-ionizable under alkaline conditions.

Preferably, the ballasting group is attached either directly or indirectly to X, and the aqueous solubilizing group is attached indirectly to X through at least one carbon atom.

In even more preferred embodiments, the release compound is selected from

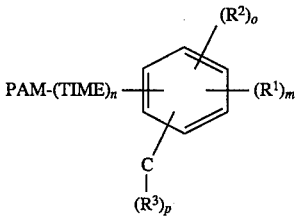

and

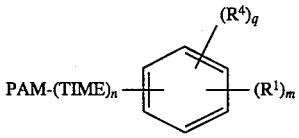

wherein $R^1$, m, n, TIME and PAM are as defined before;

$R^2$ is a group containing a ballasting group;

o is 1 or 2, preferably 1;

$R^3$ is a group containing an aqueous solubilizing group;

p is 1 or 2, preferably 1;

$R^4$ is a group containing both a ballasting group and an aqueous solubilizing group, wherein the aqueous solubilizing group is attached to the 6-membered carbocyclic ring through at least one, preferably at least three, and optimally at least five, carbon atoms that are not part of the solubilizing group; and q is 1 or 2, preferably 1.

Preferably, $R^4$ comprises an aromatic group having attached thereto

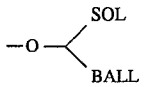

wherein

SOL is an aqueous solubilizing group; and

BALL is a ballasting group.

Optimally, the release compound employed in the present invention has the structure

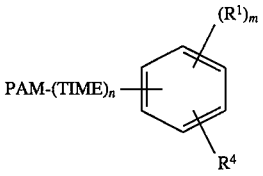

wherein $R^1$, m, n, TIME and PAM are as defined before, and $R^4$ is represented by the structure

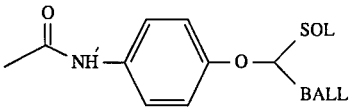

wherein BALL is a ballasting group, preferably one containing at least six carbon atoms; and SOL is a solubilizing group.

The photographically active moiety (PAM) in such instances is preferably a development inhibitor. Ideally, the ballasting group (BALL) is a substituted or unsubstituted alkyl chain containing greater than 8 contiguous carbon atoms, SOL is a carboxy group; and $R^1$ is a nitro group, with m being 2.

Representative examples of the release compounds employed in the present invention are shown in the following tables.

TABLE I-A-1

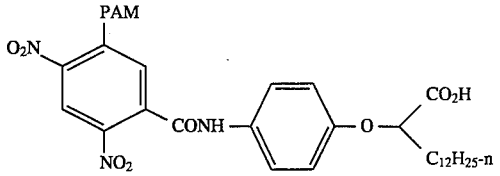

| Cmpd. No. | PAM |
|---|---|
| 1 | 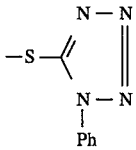 |

TABLE I-A-1-continued

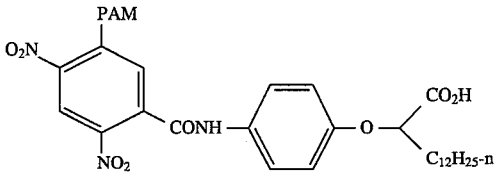

| Cmpd. No. | PAM |
|---|---|
| 2 | 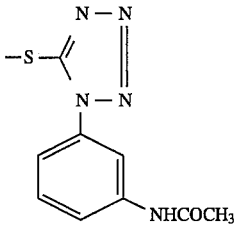 |
| 3 | 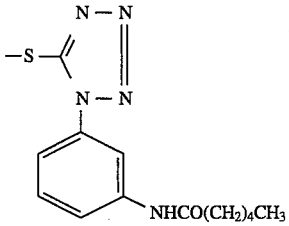 |
| 4 | 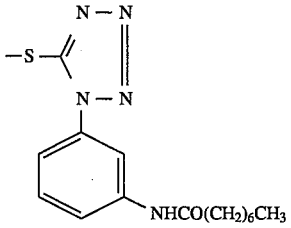 |
| 5 | 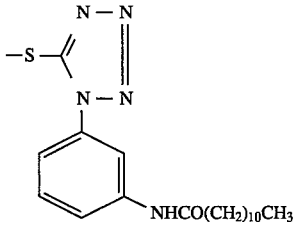 |
| 6 | 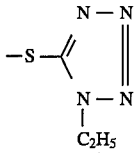 |
| 7 | 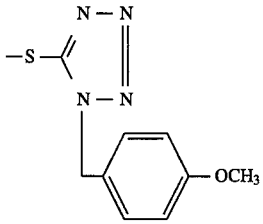 |

TABLE I-A-1-continued
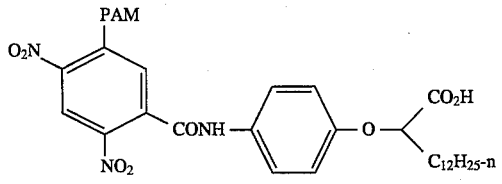
| Cmpd. No. | PAM |
|---|---|
| 8 | 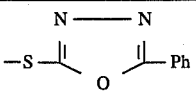 |
| 9 | 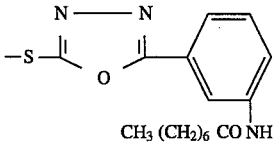 |
| 10 | 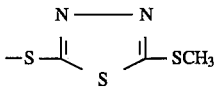 |
| 11 | 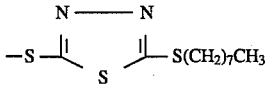 |
| 12 | 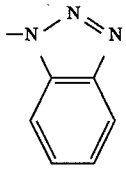 |
| 13 | 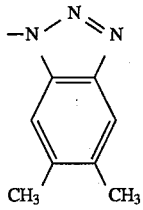 |
TABLE I-A-1-continued
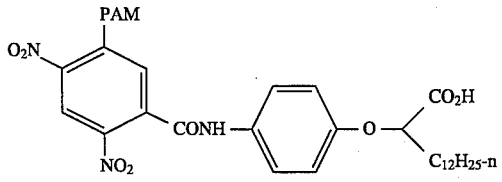
| Cmpd. No. | PAM |
|---|---|
| 14 | 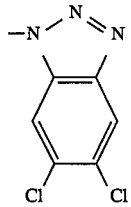 |
| 15 | 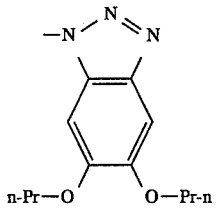 |
| 16 | 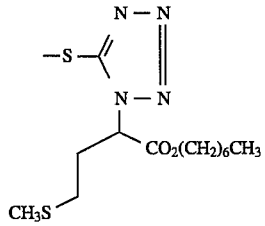 |
| 17 | 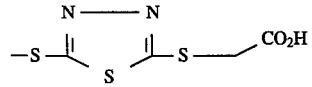 |

TABLE I-A-2
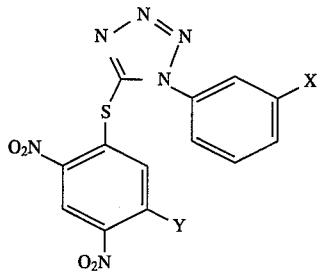
| Cmpd # | X | Y |
|---|---|---|
| 21 | H | 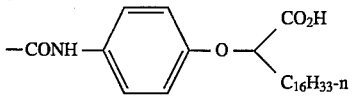 |
| 22 | $-CONHCO(CH_2)_6CH_3$ | 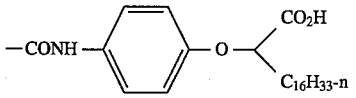 |
| 23 | $-CONHCO(CH_2)_6CH_3$ | 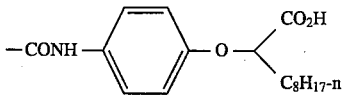 |
| 24 | H | 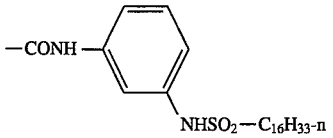 |
| 25 | $-NHCO(CH_2)_6CH_3$ | 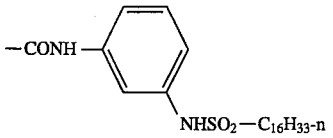 |
| 26 | H | 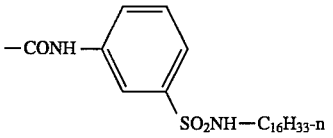 |
| 27 | $-NHCO(CH_2)_6CH_3$ | 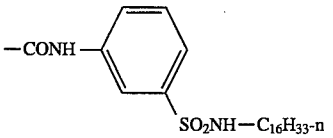 |
| 28 | H | 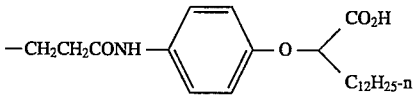 |
| 29 | $-NHCO(CH_2)_6CH_3$ | 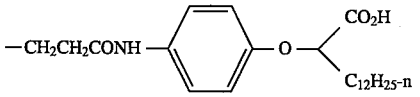 |
| 30 | $-NHCO(CH_2)_6CH_3$ | 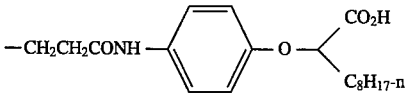 |

TABLE I-A-3
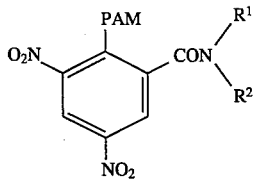
| Cmpd. # | $R^1$ | $R^2$ | PAM |
|---|---|---|---|
| 31 | H | 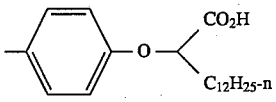 | 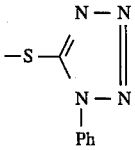 |
| 32 | H | 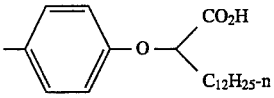 | 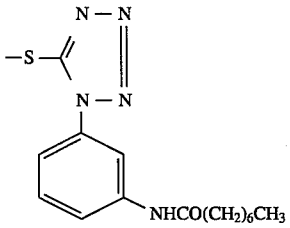 |
| 33 | H | 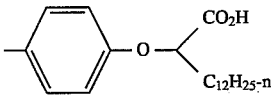 | 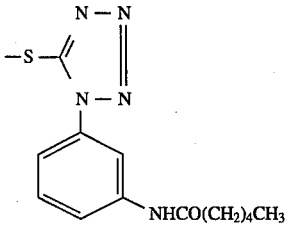 |
| 34 | H | 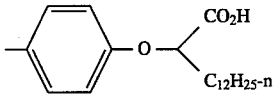 | 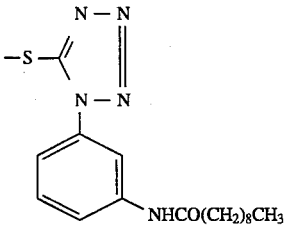 |
| 35 | H | 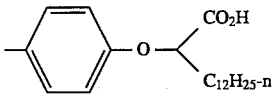 | 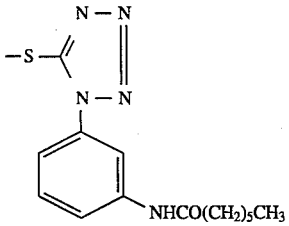 |
| 36 | H | 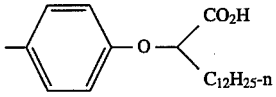 | 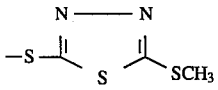 |
| 37 | H | 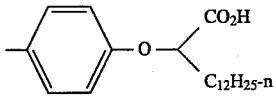 | 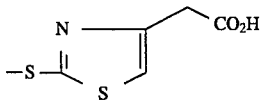 |

TABLE I-A-3-continued
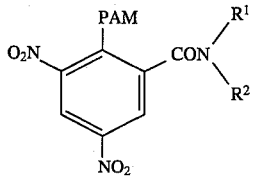
| Cmpd. # | $R^1$ | $R^2$ | PAM |
|---|---|---|---|
| 38 | H | 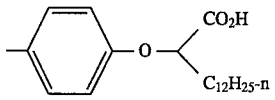 | 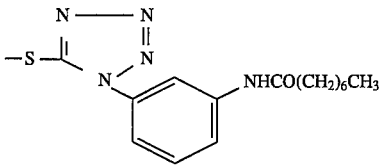 |
| 39 | $CH_3$ | 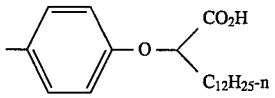 | 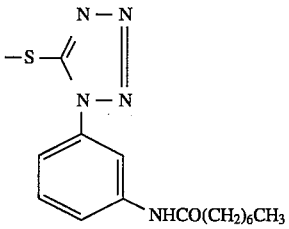 |
TABLE I-A-4
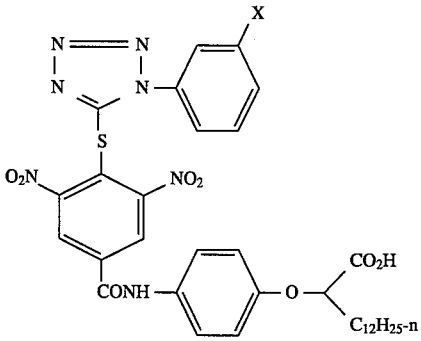
| Cmpd. # | X |
|---|---|
| 40 | H |
| 41 | $-NHCO(CH_2)_6CH_3$ |
| 42 | $-NHCOCH_3$ |

TABLE I-A-5
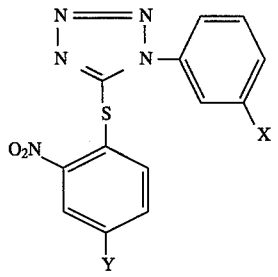
| Cmpd # | X | Y |
|---|---|---|
| 43 | H | 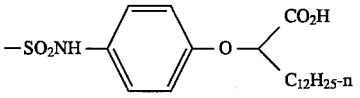 |
| 44 | $-NHCO(CH_2)_6CH_3$ | 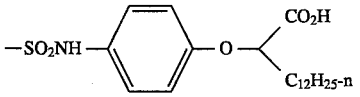 |
| 45 | H | 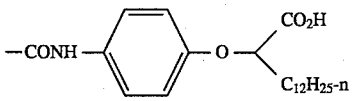 |
| 46 | $-NHCO(CH_2)_6CH_3$ | 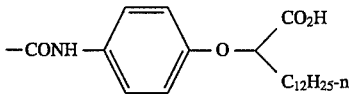 |
| 47 | H | 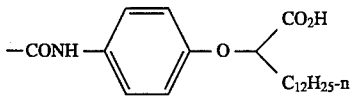 |
| 48 | $-NHCO(CH_2)_6CH_3$ | 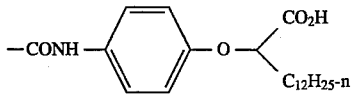 |
| 49 | $-NHCO(CH_2)_6CH_3$ | 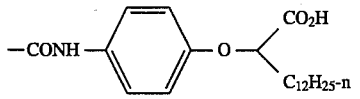 |
| 50 | H | 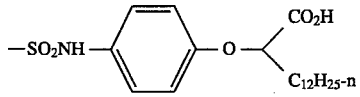 |
| 51 | H | 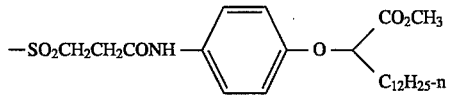 |
| 52 | $-NHCO(CH_2)_6CH_3$ | 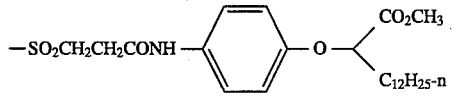 |

TABLE I-A-6

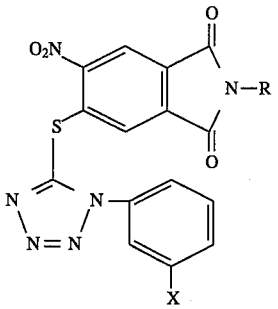

| Cmpd # | X | R |
|---|---|---|
| 53 | H | $-(CH_2)_{10}CO_2H$ |
| 54 | $-NHCO(CH_2)_6CH_3$ | $-(CH_2)_{10}CO_2H$ |
| 55 | $-NHCO(CH_2)_6CH_3$ | $-CH(CO_2H)C_{12}H_{25}$-n |

Other examples include:

56

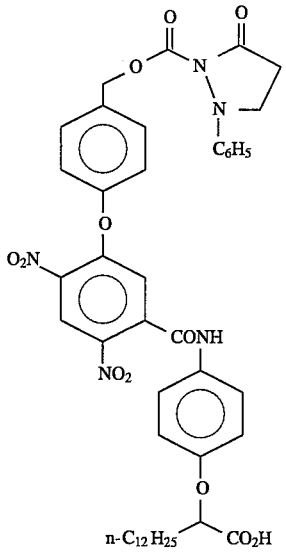

57

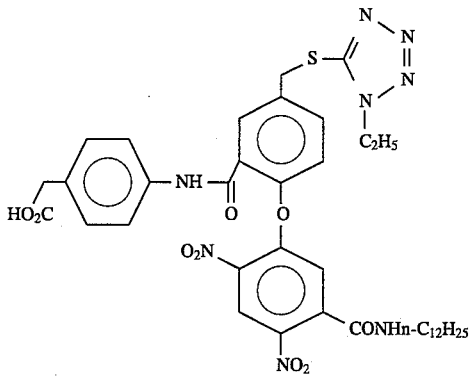

-continued

58

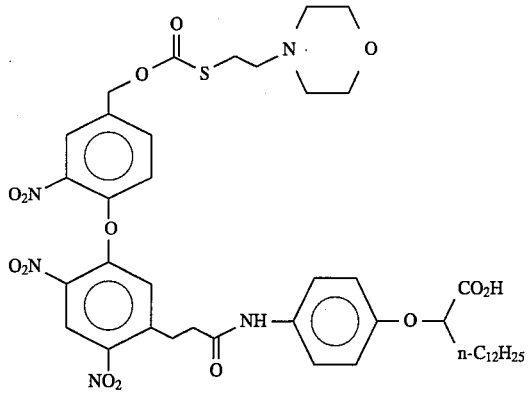

59

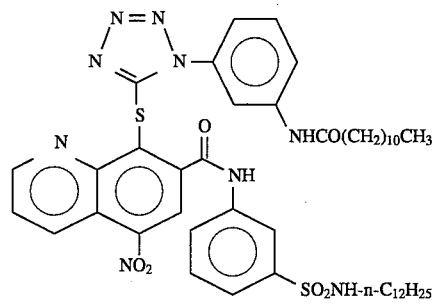

60

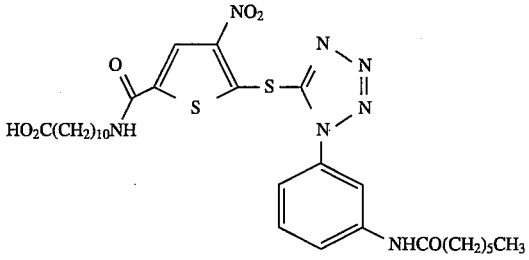

61

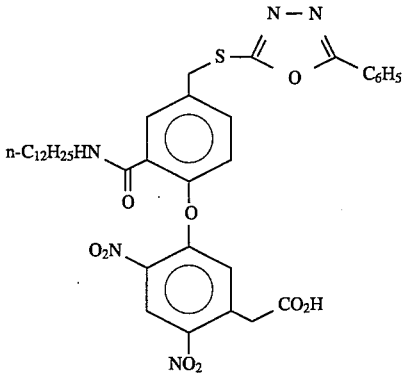

Suitable levels of release compounds utilized in the present invention are about 0.02 to about 25 millimoles/mole silver. Preferred levels are about 0.05 to about 15 millimoles/mole silver.

The release compounds employed in the present invention may be incorporated into a silver halide emulsion comprising any form (i.e. cubic, octahedral, dodecahedral, spherical or tabular) of silver halide grains. It is preferred, however, that the present invention be practiced with tabular grains having an aspect ratio greater than 2:1, preferably at least 5:1, and optimally at least 7:1. Aspect ratio as used herein is understood to mean the ratio of the equivalent circular diameter of a grain to its thickness. The equivalent circular diameter of a grain is the diameter of a circle having an area equal to the projected area of the grain.

The photographic elements of the present invention may be simple single layer elements or multilayer, multicolor elements. Multicolor elements contain dye image-forming units sensitive to each of the three primary regions of the visible light spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like.

The photographic elements may also contain a transparent magnetic recording layer such as a layer containing magnetic particles on the underside of a transparent support. Magnetic layers have been described in U.S. Pat. Nos. 4,279,945 and 4,302,523, and *Research Disclosure,* November 1992, Item No. 34390, which are incorporated herein by reference. Typically, the element will have a total thickness (excluding the support) of from about 5 to about 30 microns.

In the following discussion of suitable materials for use in the elements of this invention, reference will be made to *Research Disclosure,* December 1978, Item No. 17643, and *Research Disclosure,* December 1989, Item No. 308119, both published by Kenneth Mason Publications, Ltd., Dudley Annex, 12a North Street, Emsworth, Hampshire PO10 7DQ, ENGLAND, the disclosures of which are incorporated herein by reference. These publications will be identified hereafter by the term "Research Disclosure." A reference to a particular section in "Research Disclosure" corresponds to the appropriate section in each of the above-identified *Research Disclosures.* The elements of the invention can comprise emulsions and addenda described in these publications and publications referenced in these publications.

The silver halide emulsions employed in the elements of this invention can be comprised of silver bromide, silver chloride, silver iodide, silver bromochloride, silver iodochloride, silver iodobromide, silver iodobromochloride or mixtures thereof. Preferably, the emulsions contain relatively low levels of iodide: in the order of less than about seven percent; more preferably, less than about four percent iodide. It is also contemplated such emulsions contain less than about two percent iodide. Such emulsions are disclosed in European Patent Application 271,061, which is incorporated herein by reference.

The emulsions can include silver halide grains of any conventional shape or size. Specifically, the emulsions can include coarse, medium or fine silver halide grains. High aspect ratio tabular grain emulsions are specifically contemplated, such as those disclosed by Wilgus et al. U.S. Pat. No. 4,434,226, Daubendiek et al. U.S. Pat. No. 4,414,310, Wey U.S. Pat. No. 4,399,215, Solberg et al. U.S. Pat. No. 4,433,048, Mignot U.S. Pat. No. 4,386,156, Evans et al. U.S. Pat. No. 4,504,570, Maskasky U.S. Pat. No. 4,400,463, Wey et al. U.S. Pat. No. 4,414,306, Maskasky U.S. Pat. Nos. 4,435,501 and 4,643,966 and Daubendiek et al. U.S. Pat. Nos. 4,672,027 and 4,693,964, all of which are incorporated herein by reference. Also specifically contemplated are those silver iodobromide grains with a higher molar proportion of iodide in the core of the grain than in the periphery of the grain, such as those described in British Reference No. 1,027,146; Japanese Reference No. 54/48,521; U.S. Pat. Nos. 4,379,837; 4,444,877; 4,665,012; 4,686,178; 4,565,778; 4,728,602; 4,668,614 and 4,636,461; and in European Reference No 264,954, all of which are incorporated herein by reference. The silver halide emulsions can be either monodisperse or polydisperse as precipitated. The grain size distribution of the emulsions can be controlled by silver halide grain separation techniques or by blending silver halide emulsions of differing grain sizes.

Dopants, such as compounds of copper, iridium, thallium, lead, bismuth, cadmium and Group VIII noble metals, can be present alone, or in combination during precipitation of the silver halide emulsion. Other dopants include transition metal complexes as described in U.S. Pat. Nos. 4,981,781, 4,937,180, 4,933,272, 5,252,451 and *Research Disclosure,* Item No. 308119, Section I–D.

The emulsions can be surface-sensitive emulsions, i.e., emulsions that form latent images primarily on the surface of the silver halide grains; or internal latent image-forming emulsions, i.e., emulsions that form latent images predominantly in the interior of the silver halide grains. The emulsions can be negative-working emulsions such as surface-sensitive emulsions or unfogged internal latent image-forming emulsions, but can also be direct-positive emulsions of the unfogged, internal latent image-forming type, which are positive-working when development is conducted with uniform light exposure or in the presence of a nucleating agent. Preferably, the elements are reversal-working elements.

The silver halide emulsions can further be surface-sensitized, and noble metal (e.g., gold), middle chalcogen (e.g., sulfur, selenium, or tellurium) and reduction sensitizers, employed individually or in combination, are specifically contemplated. Typical chemical sensitizers are listed in *Research Disclosure,* Item 308119, cited above, Section III.

The silver halide emulsions can be spectrally sensitized with dyes from a variety of classes, including the polymethine dye class, which includes the cyanines, merocyanines, complex cyanines and merocyanines (i.e., tri-tetra-, and polynuclear cyanines and merocyanines), oxonols, hemioxonols, stryryls, merostyryls, and streptocyanines. Illustrative spectral sensitizing dyes are disclosed in *Research Disclosure,* Item 308119, cited above, Section IV.

Suitable vehicles for the emulsion layer and other layers of elements of this invention are described in *Research Disclosure,* Item 308119, Section IX and the publications cited therein.

The elements of this invention can include couplers as described in *Research Search,* Section VII, paragraphs D, E, F, and G and the publications cited therein. The couplers can be incorporated as described in *Research Disclosure,* Section VII, paragraph C, and the publications cited therein. Also contemplated are elements which further include image modifying couplers as described in *Research Disclosure,* Item 308119, Section VII, paragraph F. Specific examples of such image-modifying couplers are disclosed in European Patent Application 193,389.

The photographic elements of this invention can contain brighteners (*Research Disclosure,* Section V), antifoggants and stabilizers such as mercaptoazoles (for example, 1-(3-ureidophenyl)-5-mercaptotetrazole), azolium salts (for example, 3-methylbenzothiazolium tetrafluoroborate), thiosulfonate salts (for example, p-toluene thiosulfonate potassium salt), tetraazaindenes (for example, 4-hydroxy-6-methyl- 1,3,3a,7-tetraazaindene), and those described in *Research Disclosure,* Section VI, antistain agents and image dye stabilizers (*Research Disclosure,* Section VII, paragraphs I and J), light absorbing and scattering materials (*Research Disclosure,* Section VIII), hardeners (*Research Disclosure,* Section X), polyalkyleneoxide and other surfactants as described in U.S. Pat. No. 5,236,817, coating aids (*Research Disclosure,* Section XI), plasticizers and lubricants (*Research Disclosure,* Section XII), antistatic agents (*Research Disclosure,* Section XIII), matting agents (*Research Disclosure,* Section XII and XVI) and development modifiers (*Research Disclosure,* Section XXI.

The photographic elements can be coated on a variety of supports as described in *Research Disclosure,* Section XVII and the references described therein.

The photographic elements of the invention can be exposed to actinic radiation, typically in the visible region of the spectrum, to form a latent image as described in *Research Disclosure,* Section XVIII, and then processed to form a visible dye image as described in *Research Disclosure,* Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylenediamines. Especially preferred are 4-amino-3-methyl-N,N-diethylaniline hydrochloride, 4-amino-3-methyl-N-ethyl-N-(β-methanesulfonamidoethyl)-aniline sulfate hydrate, 4-amino-3-methyl-N-ethyl-N-(β-hydroxyethyl)-aniline sulfate, 4-amino-3-(β-methanesulfonamidoethyl)-N,N-diethylaniline hydrochloride, and 4-amino-N-ethyl-N-(β-methoxyethyl)-m-toluidine di-p-toluenesulfonic acid. With negative-working silver halide emulsions, the processing step described above provides a negative image. The described elements can be processed in the known C-41 color process as described in, for example, the British Journal of Photography Annual, 1988, pages 196–198. To provide a positive (or reversal) image, the color development step can be preceded by development with a non-chromogenic developing agent to develop exposed silver halide, but not form dye, and then uniformly fogging the element to render unexposed silver halide developable. Reversal processing of the element of the invention is preferably done in accordance with the known K-14 process, or the known E-6 process as described and referenced in *Research Disclosure* paragraph XIX. Alternatively, a direct positive emulsion can be employed to obtain a positive image.

Development is followed by the conventional steps of bleaching, fixing, or bleach-fixing, to remove silver or silver halide, washing, and drying. It is contemplated that the bleaching, fixing, or bleach-fixing steps be performed in the presence of a bleach accelerating compound that comprises a thiol, or precursor to a thiol, functionality. Such are described in, for example, U.S. Pat. Nos. 3,893,858, 4,780,403, 4,707,434 and 4,952,488.

EXAMPLES

The following examples illustrate the syntheses of release compounds useful in the present invention. The synthesis scheme described is representative and can be varied by those skilled in the art to obtain other useful release compounds.

Scheme 1

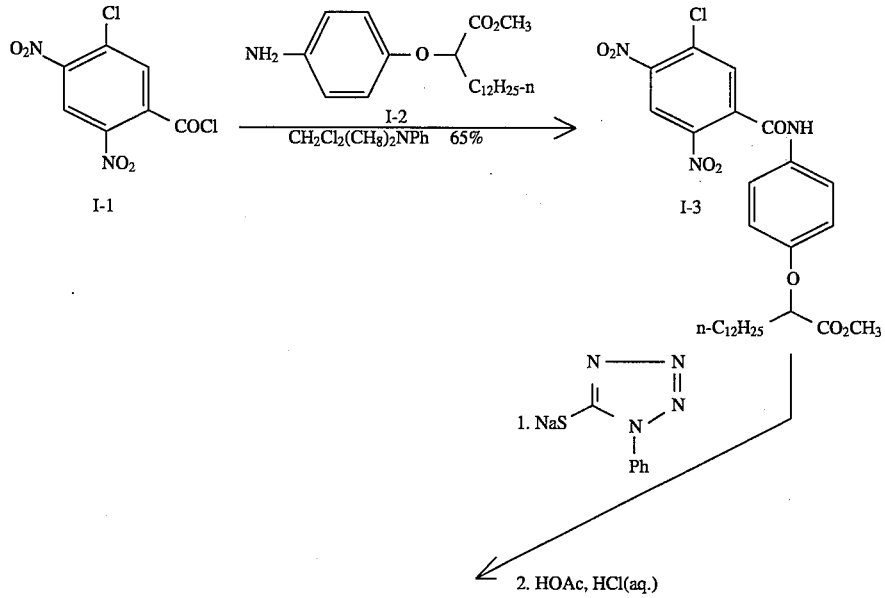

-continued

Scheme 1

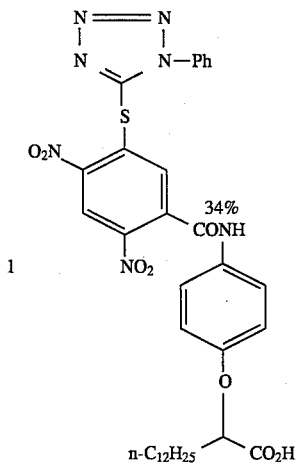

Preparation of Compound 1

Preparation of Intermediate-3 (I-3): 5-chloro- 2,4-dinitrobenzoyl chloride (I-1, 24.6 g,) in 250 mL methylene chloride was treated with a solution of N,N-dimethylaniline (35 mL) and I-2 (37.9 g) in 100 mL methylene chloride over 20 min. After the addition, the mixture was stirred at ambient temperature for 90 min. The mixture was washed with dilute hydrochloric acid, filtered through diatomaceous earth, dried, and concentrated in vacuo. The resulting oil was triturated with acetonitrile, chilled, and filtered to afford I-3 as a yellow solid (37.5 g, 65%). I-3 proved to be chromatographically homogeneous and displayed spectroscopic characteristics consistent with the assigned structure.

Preparation of compound 1: A mixture of I-3 (10.1 g) and sodium 1-phenyl-1H-tetrazole-5-thiolate (I-4, 5.2 g) was stirred in 100 mL of tetrahydrofuran at ambient temperature for 20 min. An ethyl acetate based extractive work-up afforded an oil. Silica gel chromatography eluting with mixtures of ethyl acetate in methylene chloride gave the ester as a crude oil. This oil was warmed at 85°–90° C. in a mixture of 90 mL acetic acid with 10 mL concentrated hydrochloric acid for 90 min. The mixture was diluted with water, cooled, and the solid collected by filtration. Silica gel chromatography, eluting with mixtures of ethyl acetate in methylene chloride, afforded an oil. Trituration with methanol provided compound 1 as a bright yellow solid (4.23 g, 34%). This compound proved to be chromatographically homogeneous and displayed spectroscopic characteristics consistent with its assigned structure. Combustion analysis found (calculated for $C_{34}H_{39}N_7O_8S$): N 13.8 (13.9), C 57.9 (57.9), H 5.6 (5.6).

Preparation of Compound 14

Compound I-3 was prepared as described in the preparation of Compound 1. A mixture of I-3 (4.33 g), 4,5-dichlorobenzotriazole (1.41 g) and triethylamine (1.2 ml) in 50 ml tetrahydrofuran was stirred at ambient temperature for 30 minutes, after which 1,1,3,3-tetramethylguanidine (1.0 ml) was added. The mixture was allowed to stand at ambient temperature for 15 hours after which it was poured into water. Ethyl acetate extraction work-up gave an oil which was heated in a mixture of 80 ml acetic acid and 20 ml concentrated hydrochloric acid at 100° C. for 90 minutes. The mixture was poured into water. Ethyl acetate work-up afforded an oil. Xylenes were flashed off (50 ml, 3 X) to afford a dry oil. Silica gel chromatography, eluting with ethyl acetate, afforded, upon ether/ligroin trituration, a yellow solid. Recrystallization from 1,2-dichloroethane gave a yellow solid (3.15 g, 58.8%, m.p. 157°–158° C.). This material proved to be chromotographically homogenous and displayed spectral characteristics consistent with its assigned structure. Combustion analysis found (calculated for $C_{33}H_{36}Cl_2N_6O_8$ 4:1 with $C_2H_4Cl_2$) N 11.3 (11.4), C 54.3 (54.3), H 5.0 (5.0).

Preparation of Compound 54

Preparation of Intermediate-5 (I-5): A mixture of 4-chloro-5-nitrophthalimide (4.53 g), N,N-dimethylacetamide (80 ml), methyl 11-iodoundecanoate (6.52 g) and 1,1,3,3-tetramethylguanidine were stirred at ambient temperature for fifteen minutes, then at 40° C. for one hour. The mixture was cooled to ambient temperature, then treated with 1,1,3,3-tetramethylguanidine (2.5 ml) and I-4 (N-[3-(2,5-dihydro- 5-thioxo-1H-tetrazole-1-yl)phenyl] octanamide) and stirred for 30 minutes. An additional portion of 1,1,3,3-tetramethylguanidine was added and the mixture stirred a final five minutes. The mixture was poured into cold, dilute hydrochloric acid and ethyl acetate, and worked-up. Trituration with methanol (200 ml) followed to yield I-5 methyl 11-(N-4-chloro-5-nitrophthalamido) undecanoate as a solid: (11.9 g. 84.2%, mp 126°–127° C.). The material proved to be chromatographically homogenous and displayed spectral characteristics consistent with its assigned structure.

Preparation of compound 54: Compound I-5 was heated in a mixture of 80 ml acetic acid and 20 ml concentrated hydrochloric acid at 40° C. for four hours. The mixture was diluted with 80 ml water and chilled. The solid was filtered, air dried, and recrystallized from acetonitrile to afford compound 54 as a yellow solid (3.9 g, 66.0%, m.p. 132°–133° C.). This material proved to be chromatographically homogenous and displayed spectral characteristics consistent with its assigned structure. Combustion analysis found (calculated for $C_{34}H_{43}N_7O_7S$): N 14.2 (14.1), C 59.0 (58.9), H 6.2 (6.2).

The practice of the invention is described in detail below with reference to specific illustrative examples, but the invention is not to be construed as being limited thereto.

EXAMPLE 1

Compound 1 and comparative compounds C-1, C-2 and C-3 were independently dispersed (1:2) in N,N-diethyl lauramide and coated to produce the following photographic elements.

| | |
|---|---|
| DOC | 5.38 g/m$^2$ gelatin (overcoat)<br>1.75% hardener (total gel)<br>1.61 g/m$^2$ AgBrI<br>0.77 g/m$^2$ cyan coupler Cy-1 dispersed (1:½) in dibutylphthalate<br>0.54 mmol/m$^2$ compounds 1, C-1, C-2, or C-3 (1:2) diethyl lauramide<br>2.69 g/m$^2$ gelatin |
| Support (cellulose ester film support) | |

Cy-1:

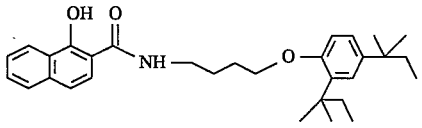

Hardener $(CH_2{=}CHSO_2CH_2)_2O$

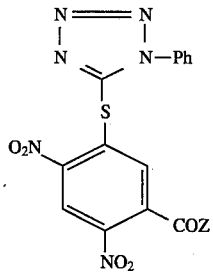

1

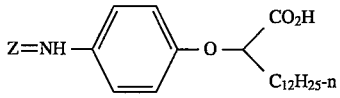

C-1 $Z{=}O{-}C_{12}H_{25}\text{-n}$

C-2

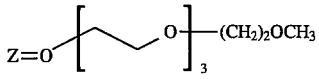

C-3

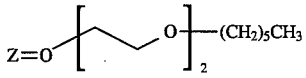

The elements were exposed to E-6 first developer for a controlled time (0, 2, 4 or 6 min), then processed through a stop bath, a wash, a fixing bath, and a final wash. The elements were then assayed by a standard calibrated HPLC extraction technique for residual compounds 1, C-1, C-2, or C-3.

The data from these experiments are found in Table 1. These data demonstrate that the nonsolubilized, ballasted compound C-1 (compound B-5 of copending U.S. Ser. No. 08/148,805) released a photographically active moiety very slowly, if at all, during processing in the E-6 first developer, while the ballasted and solubilized compound 1 was gradually decomposed during the processing, thus affording an unblocked photographically active moiety at an optimum rate. The solubilized but unballasted compound C-2 washed out of the coating, thus providing that only 50% of the compound remained even after no E-6 processing. C-3 (compound B-7 of copending U.S. Pat. No. 5,354,650) contained a polyether group having only two repeating units. Thus, it was insufficiently water soluble to allow for optimum release of the photographically active moiety.

TABLE 1

| | % Remaining Compound[b] | | | |
|---|---|---|---|---|
| t[a] | C-1 | 1 | C-2 | C-3 |
| 0 | 97 | 94 | 50 | 97 |
| 2 | 97 | 78 | — | 96 |

TABLE 1-continued

| | % Remaining Compound[b] | | | |
|---|---|---|---|---|
| t[a] | C-1 | 1 | C-2 | C-3 |
| 4 | 97 | 53 | — | 95 |
| 6 | 96 | 31 | — | 95 |

[a]t = time of exposure to the E-6 first developer at 100° F.
[b]Compared to a nonprocessed coating.

These experiments demonstrate that both ballasting and solubilization are needed to ensure both layer specific effects, i.e., no wash out of release compound, and optimum release activity.

Optimum release activity was further determined by examining the impact on release rates of different solubilization sites. Compounds were compared in terms of their release constants, as determined by spectrophotometric analysis: 25 μmoles of the compound were dissolved in a few milliliters of tetrahydrofuran. Then, 3.0 grams of reduced Triton® X- 100 (CAS No. 101013-07-4) which had previously been acidified with acetic acid, were added. The tetraydrofuran was removed by evaporation under a nitrogen stream, and then micro-filtered water was added to make 50 mL of a $5\times10^{-4}$M solution. In addition, an 0.25M $K_2HPO_4$ pH 11.0 buffer was dearated by bubbing nitrogen through it, and then used to make an 0.25M $K_2SO_3$ solution.

Two mL of the sulfite solution and 0.5 mL of the stock solution were added together by pipette to a stirred cuvette.

The cuvette holder was maintained at 26° C. using a circulating constant temperature bath. The cuvette was then covered and the absorbence at 350 nm was observed over time. The data collected were fit to a first-order rate profile.

Table 2, shown below, describes the release constants for Compounds C-5, 62 and 63.

TABLE 2

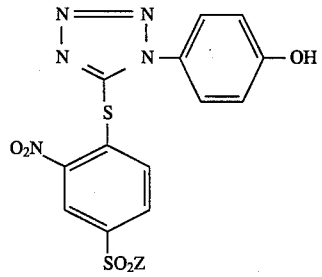

| | | |
|---|---|---|
| | C-5 | $Z=NH(CH_2)_{15}CH_3$ |
| | 62 | $Z=N(CH_3)(CH_2)_{15}CO_2H$ |
| | 63 | $Z=N(CH_3)CH(CH_2)_{13}CH_3(CO_2H)$ |
| Compound | Comparison/Invention | K relative rates of release |
| C-5 | Comparison | 0.4 |
| 62 | Invention | 1.3 |
| 63 | Invention | 1.0 |

As can be seen form the data of Table 2, release compounds such as compounds 62 and 63, which have solubilization off the aromatic ring system, i.e. separated form the ring system by at least one carbon atom, exhibit significantly faster rates of release. By contrast, when a water solubilizing group is attached directly to the aromatic ring system as in compound C-5 (compound B-9 of copending U.S. Pat. No. 5,354,650) release of the photographically active moiety occurs at an insufficient rate.

EXAMPLE 2

On a cellulose triacetate support containing a subbing layer, the compositions described below were coated to prepare a multilayer color photographic light-sensitive material which is designated as photographic element A. Components utilized are shown as g/m$^2$ except for sensitizing dyes and the release or comparison compounds which are shown in millimolar amounts/mole of silver halide present in the same layer.

| Photographic Element A | |
|---|---|
| First layer: Antihalation Layer | |
| Black Colloidal Silver | 0.43 (as silver) |
| Gelatin | 2.44 |
| Second layer: Intermediate Layer | |
| Gelatin | 1.22 |
| Third layer: Red Sensitive Layer | |
| Silver iodobromide emulsion | 0.97 (as silver) |
| Red sensitizing dyes | 0.75 |
| Cyan coupler Cy-2 | 1.62 |
| Dibutylphthalate | 0.81 |
| Gelatin | 2.37 |
| Fourth layer: Intermediate Layer | |
| Competitor-1 | 0.21 |
| Gelatin | 0.43 |
| Fifth layer: Green Sensitive Layer | |
| Silver iodobromide emulsion | 1.10 (as silver) |
| Sensitizing dye-1 | 0.75 |
| Sensitizing dye-2 | 0.25 |
| Magenta coupler Ma-2 | 0.43 |
| Magenta coupler Ma-1 | 1.08 |
| Tritolyl phosphates | 0.76 |
| Gelatin | 2.37 |
| Sixth layer: Protective layer | |
| Gelatin | 2.37 |
| Bis(vinylsulfonylmethane) | 0.19 |

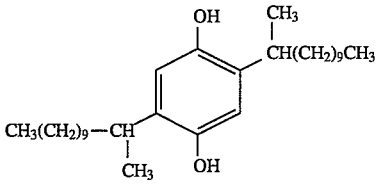

Competitor-1

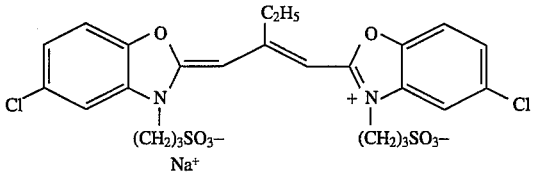

Sensitizing Dye-1

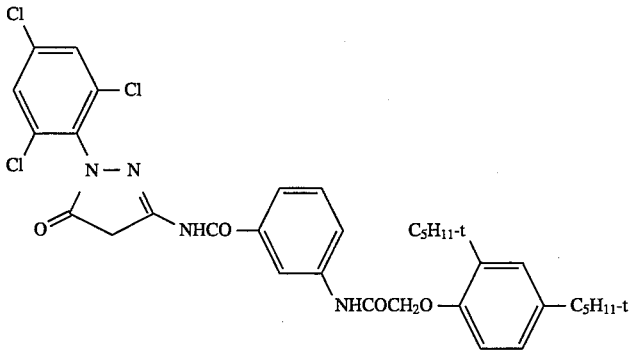

Magenta Coupler Ma-2

-continued

Photographic Element A

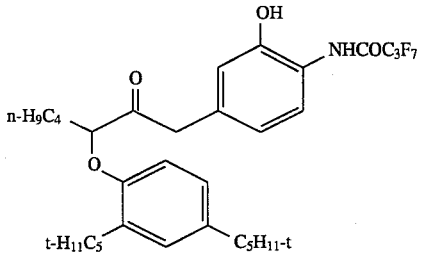

Cyan Coupler Cy-2

Three further coatings were prepared incorporating compound 32 into layer five at three levels, 0.30, 0.45, and 0.60 mmoles compound per mole silver to afford photographic elements C, D, and E, respectively. These elements along with element A were given a stepped exposure and processed through the standard E-6 process. Relative speed at two different speed points was determined and is shown in Table 3. The data clearly indicate that the photographic speed at various points of the curve can be altered by the addition of compound 32, and that increasing amounts of the release compound afford greater effects.

TABLE 3

| Photographic Element | Level Compound 32[a] | Relative Speed 1[b] | Relative Speed 2[c] |
|---|---|---|---|
| A | 0 | 1.62 | 1.84 |
| C | 0.30 | 1.47 | 1.71 |
| D | 0.45 | 1.34 | 1.64 |
| E | 0.60 | 1.30 | 1.59 |

[a]mmoles compound 32/mole silver in the layer.
[b]Photographic speed in log E units at a green density of 0.50.
[c]Photographic speed in log E units at a green density of 1.00.

EXAMPLE 3

Photographic examples were prepared as in Example 2 except that compound 4 and comparative compound C-6 were coated in layer 5 at 0.30 mmol/mole silver, to afford photographic elements F and G, respectively. These elements, along with example B, were given stepped exposures and processed in standard E-6 process, except that the time in the first developer was varied from 4 min to 11 min (the standard process has a 6-min first development step). Speed at various points along the elements' characteristic curves and D-max were determined for the different development times. This data is found in Table 4. The first three entries indicate that relative to control element B, at short processing times, the release compound 4 (element F) has negligible effects upon curve shape, whereas the comparison compound C-6, an unblocked inhibitor, causes a very large, deleterious effect on D-max and speed (element G). The last three entries are based upon a prolonged first development time (push processing) and indicate that compound 4 has released its photographically active inhibitor moiety which has exerted an advantageous effect on curve shape. Both D-max and photographic speeds are impacted, though D-max is diminished much less than in the control. Element G at 11' development has been impacted adequately by comparison compound C-6, but as noted previously, such is at the expense of deleterious effects at short processing times. Thus, the release compounds utilized in the present invention provide a means by which to selectively control photographic properties during extended processing (i.e. push processing) time without impacting such properties during normal processing times.

TABLE 4

| Photographic Element | First Developer Time | D-max[a] | Speed 1[b] | Speed 2[c] |
|---|---|---|---|---|
| B | 4' | 3.50 | 0.89 | 1.23 |
| F | 4' | 3.55 | 0.88 | 1.21 |
| G | 4' | 3.76 | 0.35 | 0.81 |
| B | 11' | 2.11 | 1.75 | 1.96 |
| F | 11' | 2.66 | 1.64 | 1.81 |
| G | 11' | 3.04 | 1.50 | 1.67 |

[a]Green D-max density.
[b]Photographic speed in log E units at a 0.50 green density.
[c]Photographic speed in log E units at a 1.00 green density.

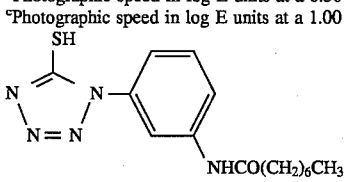

C-6

EXAMPLE 4

The release compounds employed in the present invention are most useful when they provide layer specific activity. Thus when coated in the magenta layer, it is desired that the photographically active moiety exert its effects in that layer. Using photographic elements B and F, as prepared, exposed, and processed above, the layer specific activity of the release compounds employed in the invention was examined.

Results in terms of speed and D-max for abbreviated and extended processing times are summarized in Table 5. The data demonstrate that the advantages described in example 3 are clearly evident in the record in which the release compound was coated, i.e. the green photographic record, and minimally evident in the other record, i.e. the red record. Compounds such as release compound 4 afford desirable temporal effects in a single color record of a multilayer film.

TABLE 5

| Photographic Element | Processing Time | Green[a] D-max | Green[b] Speed 1 | Red[c] D-max | Red[d] Speed 1 |
|---|---|---|---|---|---|
| B | 4' | 3.50 | 0.89 | 2.53 | 0.59 |
| F | 4' | 3.55 | 0.88 | 2.59 | 0.55 |
| B | 11' | 2.11 | 1.75 | 1.14 | 1.70 |
| F | 11' | 2.66 | 1.64 | 1.22 | 1.67 |

[a]Green density at D-max.
[b]Photographic speed in units of log E at a green density of 0.5.
[c]Red density at D-max.
[d]Photographic speed in units of log E at a red density of 0.5.

The invention has been described in detail with particular reference to preferred embodiments thereof, but it will be understood that variations and modifications can be effected within the spirit and scope of the invention.

What is claimed:

1. A silver halide color reversal, black and white, or color negative photographic element comprising a support having located thereon at least one silver halide emulsion layer, the element containing a release compound that provides a non-imagewise distribution of a photographically active moiety other than a developing agent, wherein;

(a) the release compound comprises a blocking group from which the photographically active moiety is released, a ballasting group other than a coupler moiety, and an aqueous solubilizing group, both the ballasting group and the aqueous solubilizing group being attached to the blocking group and not directly to the photographically active moiety;

(b) the blocking group comprises an aromatic ring system which is unsubstituted or substituted with one or more electron withdrawing groups and, optionally, a timing group or series of timing groups;

(c) the aqueous solubilizing group is attached, either directly or indirectly, to a timing group, or is attached indirectly through at least one carbon atom to the aromatic ring system; and (d) the active functionality of the photographically active moiety is a heteroatom which is blocked by direct attachment to the timing group or aromatic ring of the aromatic ring system.

2. A photographic element according to claim 1 wherein the aromatic ring system is substituted with one or more electron withdrawing groups.

3. A photographic element according to claim 2 wherein the photographic element is a color reversal or black and white photographic element.

4. A photographic element according to claim 1 wherein the aromatic ring system is capable of being removed from the blocking group to release the timed or untimed photographically active moiety during processing as a result of reaction with a nucleophile contained in a processing bath.

5. A photographic element according to claim 1 wherein the release compound has the structure

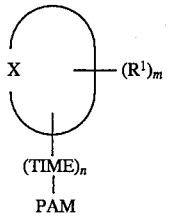

wherein

X represents the atoms to complete an aromatic ring system;

$R^1$ is an electron withdrawing moiety;

m is 0, 1, 2 or 3;

TIME is a timing group;

n is 0, 1, 2 or 3;

PAM is a photographically active moiety; and wherein the release compound further comprises a ballasting group other than a coupler moiety, and an aqueous solubilizing group, the ballasting group attached either directly or indirectly to TIME or X, and the aqueous solubilizing group attached either directly or indirectly to TIME, or attached indirectly to X through at least one carbon atom.

6. A photographic element according to claim 5 wherein X represents a five or six membered aromatic ring comprised of substituted or unsubstituted carbon atoms, or nitrogen atoms wherein no more than three nitrogen atoms are present in the ring.

7. A photographic element according to claim 6 wherein the ballasting group is attached either directly or indirectly to X, and the aqueous solubilizing group is attached indirectly to X through at least one carbon atom.

8. A photographic element according to claim 7 wherein the release compound is selected from

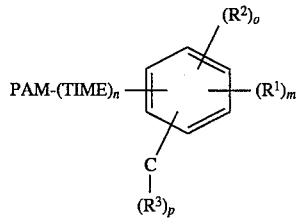

and

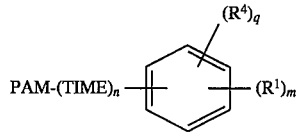

wherein $R^1$, m, n, TIME and PAM are as defined in claim 5;

$R^2$ is a group containing a ballasting group;

o is 1 or 2;

$R^3$ is a group containing an aqueous solubilizing group;

p is 1 or 2;

$R^4$ is a group containing both a ballasting group and an aqueous solubilizing group, wherein the aqueous solubilizing group is attached to the 6-membered carbocyclic ring through at least one carbon atom; and q is 1 or 2.

9. A photographic element according to claim 8 wherein $R^4$ comprises a substituted or unsubstituted aromatic group having attached thereto

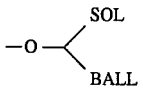

wherein

SOL is an aqueous solubilizing group; and

BALL is a ballasting group.

10. A photographic element according to claim 9 wherein the release compound has the structure

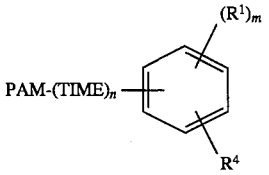

wherein $R^1$, m, n, TIME and PAM are as defined in claim 5, and $R^4$ is represented by the structure

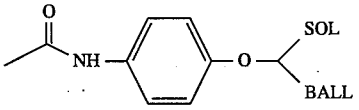

wherein BALL is a substituted or unsubstituted ballasting group, and SOL is a solubilizing group.

11. A photographic element according to claim 10 wherein PAM is selected from development accelerators, development inhibitors, bleach accelerators, and bleach inhibitors.

12. A photographic element according to claim 11 wherein the release compound is

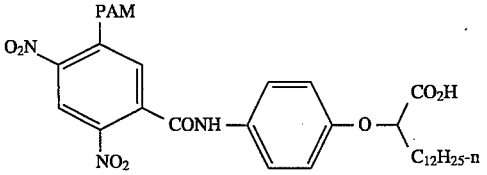

wherein PAM is as described in claim 11.

* * * * *